US005421805A

United States Patent [19]

Baxter et al.

[11] Patent Number: 5,421,805

[45] Date of Patent: Jun. 6, 1995

[54] METHOD AND APPARATUS FOR PRODUCING HANDLED BAGS

[75] Inventors: Robert O. Baxter; Bobby R. Wilson, both of West Monroe, La.

[73] Assignee: Bancroft Bag, Inc., West Monroe, La.

[21] Appl. No.: 130,554

[22] Filed: Oct. 1, 1993

[51] Int. Cl.[6] ..... B31B 37/86; B31B 37/16

[52] U.S. Cl. ..... 493/226; 493/234; 493/239; 493/362

[58] Field of Search ..... 493/226, 233, 234, 238, 493/239, 362

[56] References Cited

U.S. PATENT DOCUMENTS

| | | | |
|---|---|---|---|
| 1,906,813 | 5/1933 | Royal | 493/239 |
| 1,941,272 | 12/1933 | Potdevin | 493/233 |
| 2,013,086 | 9/1935 | Baker | 493/234 |
| 2,247,069 | 6/1941 | Sargent et al. | 493/239 |
| 2,466,823 | 4/1949 | Poppe | 493/238 |
| 2,844,075 | 7/1958 | Davis et al. . | |
| 2,847,914 | 8/1958 | Davis . | |
| 2,855,832 | 10/1958 | Mengis . | |
| 3,040,633 | 6/1962 | Davis . | |
| 3,143,936 | 8/1964 | Becker . | |
| 3,168,016 | 2/1965 | Kehr | 493/234 |
| 3,203,323 | 8/1965 | Adams et al. . | |
| 3,464,325 | 9/1969 | Class . | |
| 3,481,256 | 12/1969 | Hayes . | |
| 3,494,264 | 2/1970 | Class . | |
| 3,613,288 | 10/1971 | Ross | 493/234 |
| 3,722,377 | 3/1973 | Hayes . | |
| 3,850,724 | 11/1974 | Lehmacher . | |
| 4,069,964 | 1/1978 | Willet et al. . | |
| 4,088,264 | 5/1978 | Vogt . | |
| 4,480,752 | 11/1984 | Jacobs . | |
| 4,785,696 | 11/1988 | Martiny | 493/362 |
| 5,040,904 | 8/1991 | Cornwell . | |
| 5,102,383 | 4/1992 | Achelpohl et al. | 493/226 |
| 5,312,032 | 5/1994 | Rautenberg et al. | 493/362 |

*Primary Examiner*—William E. Terrell
*Attorney, Agent, or Firm*—Finnegan, Henderson, Farabow, Garrett & Dunner

[57] ABSTRACT

Apparatus for producing handled bags includes a web dispenser; a perforator for creating perforated seams transversely across the web at predetermined intervals to generate a succession of adjacent web sections; means for attaching at least one handle to each web section; a tube forming mechanism for configuring the web into a tubular configuration; a separating device for breaking the perforated seams to separate the adjacent web sections without disturbing the handles; and a bottom forming mechanism for closing the bottom end of each separated web section. The separating device includes a rotatable first breaker roll having a pressure bar provided thereon and a rotatable second breaker roll having a cooperating gap formed therein for receiving the pressure bar as the first and second breaker rolls are synchronously rotated with the web fed therebetween. The pressure bar includes a contoured edge surface with relief notches appropriately formed therein to receive the handles; and the cooperating gap includes angled sidewalls and is provided with a resilient material therein. A method for performing various steps in accordance with the elements of the apparatus is also included.

13 Claims, 6 Drawing Sheets

METHOD AND APPARATUS FOR PRODUCING HANDLED BAGS

BACKGROUND OF THE INVENTION

1. Field of the Invention

The present invention relates to a method and apparatus for producing a handled bag having a top edge which is free of discontinuities and irregularities. In particular, the present invention is directed to a method and apparatus for producing a handled bag from a web of sheet material by creating perforated seams transversely across the web, and attaching handles proximate the perforated seams so to extend beyond the top of each bag when the perforated seam is broken. The present invention is further directed to a method and separating device for efficiently breaking perforated seams using a set of synchronously rotating first and second breaker rolls.

2. Description of the Related Art

Handled bags are produced and sold in a variety of configurations and sizes. Perhaps one of the most popular of these configurations is a "self-opening square" bag having a twisted paper rope handle. These handled bags are frequently used in department stores, shopping malls, and fashion boutiques. Typically, the bottom of the self-opening square bag is folded on to the top side or seam side of the bag.

FIG. 1 schematically illustrates a common method of producing handled bags 50' having two U-shaped handles 40'. Conventionally, four cross cut segments A are first provided in a spaced relationship across a web of sheet material 10'. The spaced relationship of the four cross cut segments A must be predetermined, so as to correspond with the placement of two handles 40' which are subsequently affixed to the web 10'. The web 10' is then folded and flattened with the opposite longitudinal edges 11' of the web being joined to form a tubular configuration. The conventional handled bag producing method then requires that a second series of cross cuts B be provided across the web 10' in alignment with the initial four cross cut segments A to separate the tubular bag section from the web 10'. Subsequently, the bottom end of the tubular bag section is closed to complete production of the handled bag 50'.

In actuality, however, it has been observed that the second series of cross cuts B are frequently provided in a spaced or misaligned relationship relative to the initial four cross cut segments A. This creates an unappealing, jagged edge along the top of the bag 50'. Likewise, it has been observed that the attached handles 40' are often misaligned, severed or detached upon completion of the conventional handled bag producing method. This has been known to result in jamming or malfunctioning of the handled bag producing apparatus. These undesirable results are typically due to tolerance limitations in conventional machinery and inherent spacing discrepancies resulting from slack or tension in the web. Hence, there is a need for a method and apparatus for efficiently producing a handled bag having a continuous, substantially smooth top edge which may be performed automatically and provides predictable results.

Further examples of known bag producing methods are demonstrated by U.S. Pat. No. 3,040,633 issued to Davis; U.S. Pat. No. 3,143,936 issued to Becker; U.S. Pat. Nos. 3,464,325 and 3,494,264 issued to Class; and U.S. Pat. No. 3,722,377 issued to Hayes. Likewise, handled bag producing apparatus are shown by U.S. Pat. No. 2,844,075 issued to Davis et al.; U.S. Pat. No. 2,847,914 issued to Davis.; U.S. Pat. No. 2,855,832 issued to Mengis; U.S. Pat. No. 3,481,256 issued to Hayes; and U.S. Pat. No. 3,850,724 issued to Lehmacher. Additional bag making methods and apparatus are shown by U.S. Pat. No. 3,203,323 issued to Adams et al.; U.S. Pat. No. 4,069,964 issued to Willet et al.; U.S. Pat. No. 4,480,752 issued to Jacobs; U.S. Pat. No. 4,088,264 issued to Voqt; and U.S. Pat. No. 5,040,904 issued to Cornwell. However, these bag producing methods and apparatus have not necessarily proven to be effective in satisfying the needs of the handled bag producing art.

SUMMARY OF THE INVENTION

The advantages and purpose of the invention will be set forth in part in the description which follows, and in part will be obvious from the description, or may be learned by practice of the invention. The advantages and purpose of the invention will be realized and attained by means of the steps, elements, and combinations particularly pointed out in the appended claims.

To achieve the advantages and in accordance with the purpose of the invention, as embodied and broadly described herein, the present invention includes a method for producing handled bags. The method includes the steps of creating perforated seams transversely across a web of sheet material at predetermined intervals to define a web section between two subsequently created perforated seams such that a succession of adjacent web sections is generated; attaching at least one handle to each web section proximate one of the two subsequently created perforated seams; configuring the web into a tubular configuration; running the web through a separating device to break the perforated seams and separate the adjacent web sections, wherein the separating device includes a rotatable first breaker roll having a pressure bar provided thereon and a rotatable second breaker roll having a cooperating gap formed therein for receiving the pressure bar as the first and second breaker rolls are synchronously rotated; and closing the bottom end of the tubular bag section. Additional details relevant to these steps are understood from the description of the apparatus provided below.

The present invention is further directed to an apparatus for producing handled bags. The apparatus includes a web dispenser for continuously feeding a web of sheet material through the apparatus; and a perforator for creating perforated seams transversely across the web at predetermined intervals to define a web section between two subsequently created perforated seams such that a succession of adjacent web sections is generated. Each perforated seam created by the perforator includes a continuous series of perforations sufficiently spaced apart to maintain a connection between adjacent web sections. The perforated seam may be either linear in configuration or shaped to provide the handled bag with a profiled top edge. In a preferred embodiment of the apparatus, the perforator includes a rotatable knife member having a blade edge corresponding to the series of perforations, and a cooperating rotatable backing member having a backing surface for engagement with the blade edge. The synchronous engagement between the knife member and the backing member create the perforated seam as the web is fed therebetween.

The apparatus further includes a provision for attaching at least one handle to each web section proximate one of the two corresponding subsequently created perforated seams which define the web section. Preferably, two handles are attached to each section, wherein each handle includes a fixed end attached to the web section and a free end extending across the perforated seam which is proximate to where the handle is attached. Each handle may include a flat base portion which is attached to the web with an adhesive by the attaching means, and a substantially U-shaped twisted rope portion which is positioned to extend across the perforated seam. However, any of a variety of handles may be actually utilized.

Further included in the apparatus of the present invention is a tube forming mechanism for configuring the web into a tubular configuration. The tube forming mechanism includes a series of guide members and rotatable drums which appropriately fold the web and join the opposite longitudinal edges of the web into the desired tubular configuration. Preferably, the tube forming mechanism includes an applicator for applying an adhesive to join the opposite longitudinal edges of the web.

In accordance with the invention, a separating device is provided for breaking the perforated seams to separate the adjacent web sections. Each separated web section has a top end with the free end of the attached handle extending therefrom and a bottom end opposite the top end. Preferably, the top end includes a substantially smooth top edge which is free from discontinuities or irregularities.

To break each perforated seam efficiently, and further in accordance with the invention, the separating device includes a rotatable first breaker roll having a pressure bar provided thereon, and a rotatable second breaker roll having a cooperating gap formed therein for receiving the pressure bar as the first and second breaker rolls are synchronously rotated. The first and second breaker rolls are operatively coordinated with the perforator, such that the perforated seams are successively aligned with the pressure bar as the pressure bar is received by the cooperating gap with the web fed between the rolls. In this manner, each perforated seam is broken by the pressure bar and cooperating gap without disturbing the attached handles.

The pressure bar of the separating device embodied herein may include an elongate element which is shaped to correspond to the perforated seam, and extend transversely across the web. The pressure bar has an edge surface which may be either straight or contoured, e.g., convex or concave, as viewed from the front. At least one relief notch is appropriately located along the edge surface in the preferred embodiment to accommodate the handles and permit each perforated seam to be broken by the pressure bar and cooperating gap without disturbing the attached handles. A resilient material is provided within the cooperating gap of the second breaker roll to resiliently engage the edge surface of pressure bar. In a preferred embodiment, the separating device further includes a pair of rotatable separator rolls located downstream of the first and second breaker rolls. The pair of separator rolls synchronously rotate faster than the first and second breaker rolls to substantially pull each separated web section from the web as the perforated seam is broken by the pressure bar and cooperating gap.

To complete production of the handled bag in accordance with the present invention, the apparatus includes a bottom forming mechanism for closing the bottom end of the tubular bag section. A conventional bottom forming mechanism which includes a series of guide members and rotating drums may be used.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate embodiments of the invention and together with the description, serve to explain the principles of the invention. In the drawings.

DESCRIPTION OF THE PREFERRED EMBODIMENT

Figure 1:
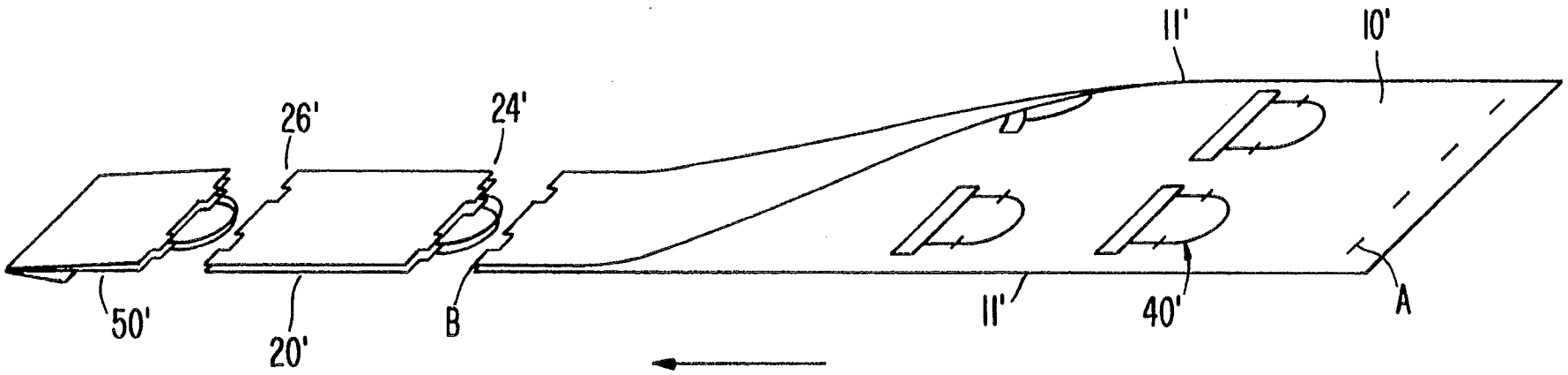
FIG. 1 is a schematic illustration of a known method for producing handled bags.

Reference will now be made in detail to the present preferred embodiments of the invention, examples of which are illustrated in the accompanying drawings. Wherever possible, the same reference numerals will be used throughout the drawings to refer to the same or like elements.

The Method

Generally, the method of the present invention enables efficient production of a handled bag having a top edge which is free of discontinuities and irregularities. The method steps for producing the handled bag in accordance with the method of the present invention are broadly depicted in FIG. 2.

Figure 2:
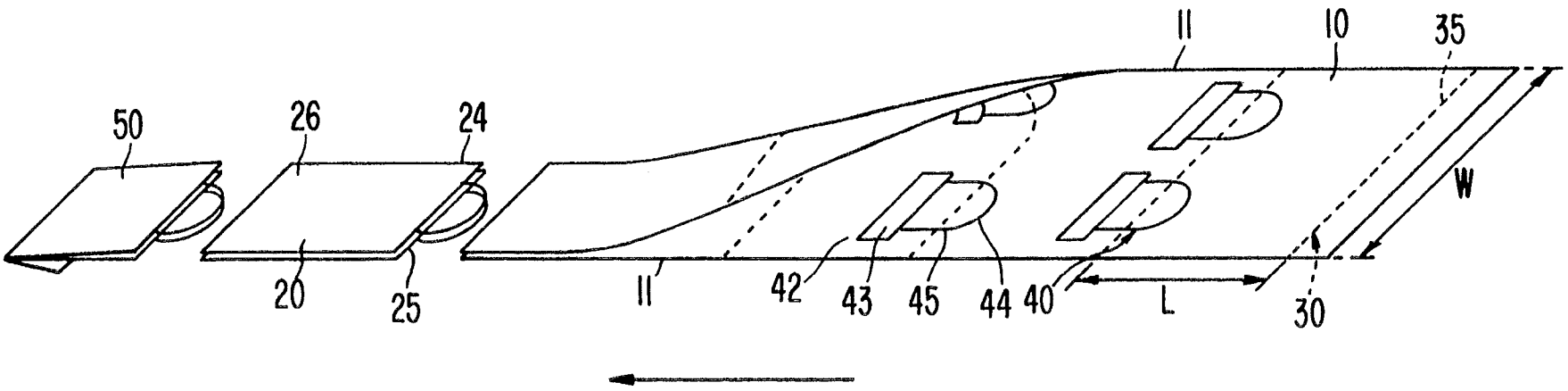
FIG. 2 is a schematic illustration of an exemplary embodiment of the method for producing handled bags in accordance with the present invention.

Initially, and as indicated in FIG. 2, the bag producing method includes the step of creating perforated seams 30 transversely across a web 10 of sheet material at predetermined intervals to define a web section 20 between two subsequently created perforated seams 30 such that a succession of adjacent web sections 20 is generated. A variety of different sheet materials may be used for production of the handled bags 50 in accordance with the method of the present invention, including plastic, paper, or combinations of the two. Generally, the web 10 of sheet material is substantially continuous in length, and has a width W of about 20 to 48 inches between its opposite longitudinal edges 11. As embodied herein, a web 10 of sheet material, such as bleached clay-coated kraft, having a weight of between about 40 and 80 pounds per 3,000 square foot ream (#/ream) is preferred.

As noted in FIG. 2, each perforated seam 30 includes a continuous series of perforations 35 sufficiently spaced apart to maintain a connection between adjacent web sections 20. As embodied herein, the perforations 35 are elongate in shape with a length of between about 1/16 and 3/32 inches, and a spacing between adjacent perforations 35 of between about 1/32 and about 3/32 inches. In the preferred embodiment of the handled bag producing method, each perforation 35 has a length of about ⅛ inch with a spacing between adjacent perforations of about 3/32 inches, i.e., about 5 perforations per inch. Alternative configurations and spacings for the perforations 35 may likewise be utilized, depending upon the type of sheet material used and the desired smoothness or continuity of the top edge 25.

FIG. 2 shows each perforated seam 30 being created linearly or as a substantially straight transverse line across the web 10. However, the perforated seam 30 may likewise be created with a predefined shaped configuration to provide the top edge 25 of the produced handled bag 50 with a particular profile. The shaped configuration of the perforated seam 30 will be dependent upon the desired profile of top edge 25, and the manner in which the web 10 is to be folded into a tubular configuration to produce the handled bag 50, as will be described below.

In accordance with the present invention, the bag producing method next includes the step of attaching at least one handle to each web section proximate one of the two subsequently created perforated seams. As seen in FIG. 2, and as embodied herein, two handles 40 are attached proximate the perforated seam 30. Each handle 40 includes a fixed end 42, which is attached to the web section 20, and a free end 44 positioned to extend across the perforated seam 30 which is proximate to the location of the attached handle 40. The orientation of the handle 40 is dependent upon the manner in which production of the handled bag 50 is to be completed, as will be discussed.

A variety of handle configurations are possible. The handled bag producing method embodied in FIG. 2 utilizes a handle 40 having a flat base portion 43 which forms the fixed end 42 to be attached to the web 10 and a substantially U-shaped portion 45 which forms the free end 44 of the handle 40. Preferably, the flat base portion 43 is a sheet member made of kraft, while the substantially U-shaped portion 45 is a length of twisted paper rope. The fixed end 42 of the handle 40 is attached to the web section 20 using an adhesive, such as a starch/acetate mixture, although alternate attaching means are possible.

The method of the present invention may also include the step of fabricating the handles 40 to be attached to the web section 20. A variety of handle 40 fabricating methods are known, and may be incorporated into the handled bag producing method of the present invention. For example, and as embodied herein, one such method includes providing a twisted paper rope segment of predetermined length, bending the rope segment into a substantially U-shaped pattern, and fixing the rope segment to a flat base member. In this manner, the flat base member can easily be attached to the web section 20 proximate a perforated seam 30.

After the handle has been attached to the web section, and in accordance with the present invention, the bag producing method further includes the step of configuring the web into a tubular configuration. Generally, the web 10 is configured into a tubular configuration using a series of guide members and rotatable drums to crease and fold the web 10. The specific combination of guide members and rotatable drums to be utilized is dependent upon the tubular configuration desired. However, such tube forming mechanisms are generally known in the art. As further embodied herein, the step of configuring the web 10 into a tubular configuration also includes joining the opposite longitudinal edges 11 of the web section 20 to complete the tubular configuration. Preferably the axial edges are joined using an adhesive, such as a starch/acetate mixture. In one preferred embodiment of the present invention, self-opening square type handled bags 50 are produced. That is, the web 10 is configured into a flat tubular configuration having a front panel, a rear panel, and a pair of collapsible accordion side panels. However, alternative bag configurations may likewise be formed.

In accordance with the present invention, the bag producing method further includes separating the adjacent web sections. Each separated web section 20 has a top end 24 with the free end 44 of the attached handle 40 extending therefrom, and a bottom end 26 opposite the top end 24. To minimize the risk of disturbing the attached handle 40, and further in accordance with the present invention, the step of separating each web section 20 is performed by running the web 10 through a separating device to break the perforated seams 30.

Figure 4B:
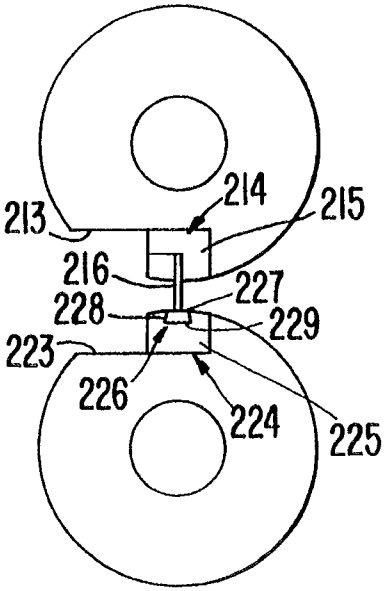
FIG. 4B is a side view of the separating device of FIG. 4A.
Figure 4A:
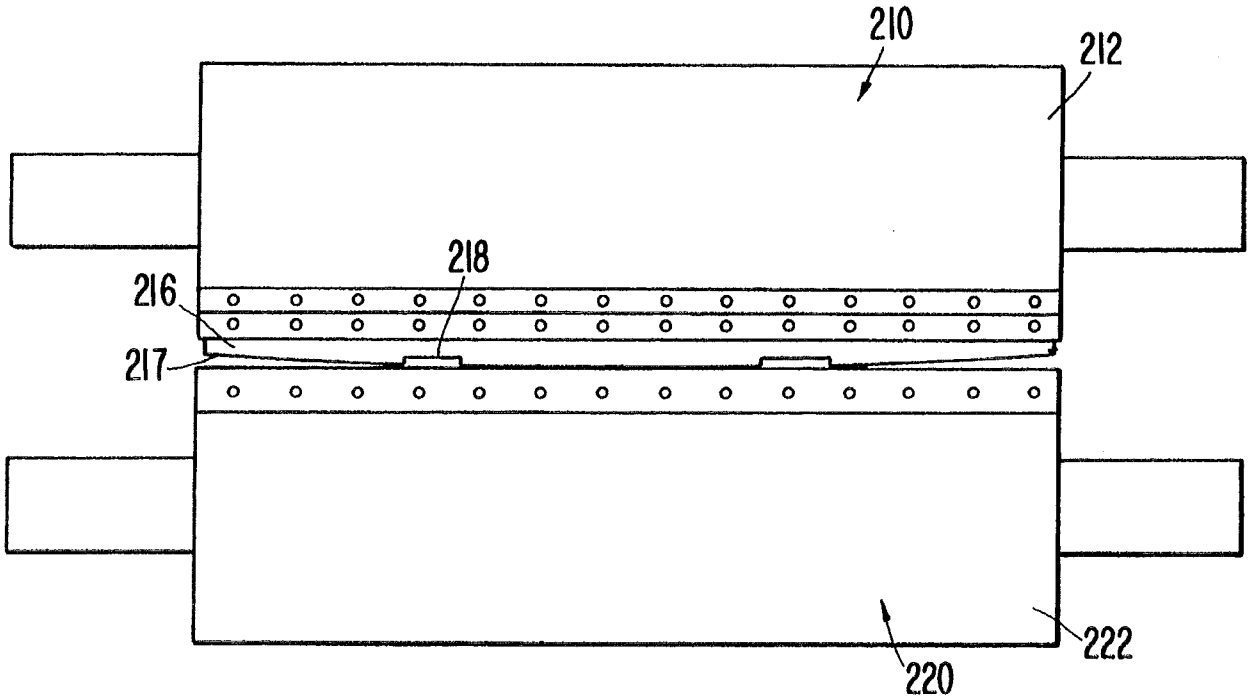
FIG. 4A is a front view of one illustrative embodiment of the separating device of the present invention having a pressure bar with a convex edge surface.
Figure 5B:
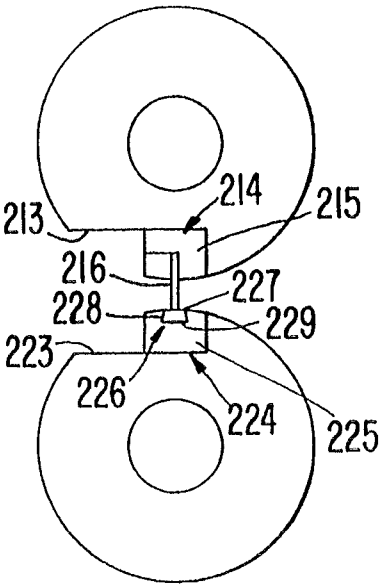
FIG. 5B is a side view of the separating device of FIG. 5A.
Figure 5A:
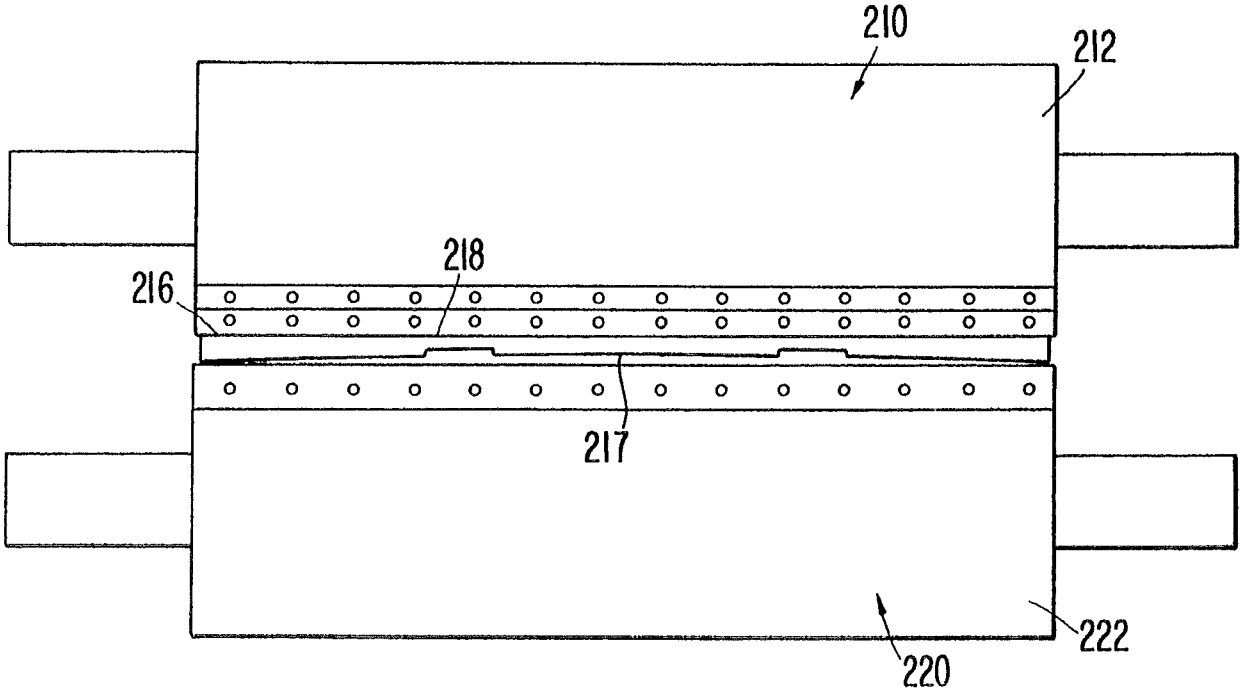
FIG. 5A is a front view of another embodiment of the separating device of the present invention having a pressure bar with a concave edge surface.

As embodied herein, and as seen in FIGS. 4A and 5A, the separating device 200 includes a rotatable first breaker roll 210 having a pressure bar 216 provided thereon and a rotatable second breaker roll 220 having a cooperating gap 226 for receiving the pressure bar 216 as the first and second breaker rolls 210,220 are synchronously rotated. The web 10 is fed between the first and second breaker rolls 210,220 such that the perforated seams 30 are successively aligned with the pressure bar 216 as the pressure bar 216 is received by the cooperating gap 226. Each perforated seam 30 is broken by the engagement between the pressure bar 216 and the cooperating gap 226 with the web 10 positioned therebetween. Hence, an edge which is free of discontinuities can be formed along each broken perforated seam 30, without disturbing the handle 40. Additional aspects regarding the operation and construction of separating device 200 of the present invention are addressed in detail below.

Finally, and in accordance with the present invention, the handled bag producing method includes closing the bottom end 26 of each separated web section 20. As with the step of configuring the web 10 into a tubular configuration, it is generally known to use a series of guide members and rotatable drums to perform this step and complete production of each handled bag 50.

The Apparatus

Figure 3:
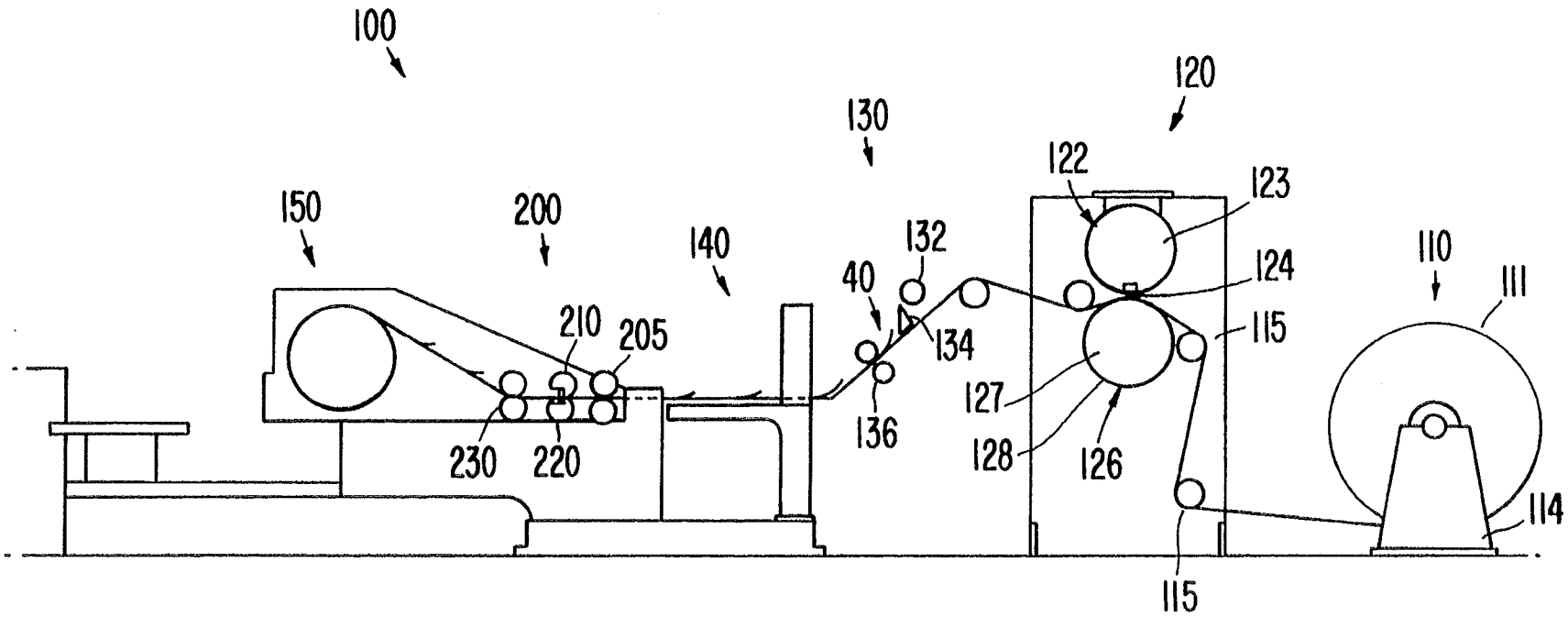
FIG. 3 is a schematic side view of an exemplary embodiment of an apparatus for producing handled bags in accordance with the present invention.

The present invention further includes an apparatus for producing handled bags. For purpose of illustration, FIG. 3 presents a schematic side view of a representative embodiment of the handled bag producing apparatus of the present invention, as generally designated by reference character 100.

To perform the method steps set forth above, and in accordance with the present invention, the apparatus 100 includes a web dispenser 110 for feeding a web 10 of sheet material. As previously mentioned, the web 10 of sheet material is generally continuous in length and has a width W of between about 20 and 48 inches. It is preferred that the web 10 is spooled onto a roll for easy dispensing. The representative embodiment of the apparatus 100, as seen in FIG. 3, includes a roll stand 114 for rotatably supporting the web roll 111. In this manner, the web 10 of sheet material may be continuously fed through the apparatus 100 from the roll stand 114. Although the roll stand 114 itself may include means for driving rotation of the web roll 111, a preferred embodiment of the present invention includes a pair of drive rollers 205 operatively located downstream to substantially pull the web 10 from the web roll 111. Guide rollers 115 are provided to guide the web 10 through the apparatus 100.

In accordance with the present invention, the apparatus includes a perforator downstream of the web dispenser for creating perforated seams 30 transversely across the web 10 at predetermined intervals to define a web section 20 between two subsequently created perforated seams 30. The length L of each web section 20 is established by the predetermined interval between the two subsequently created perforated seams 30. Each perforated seam 30 includes a continuous series of perforations 35 sufficiently spaced apart to maintain a connection between the adjacent web sections 20. In this manner, and in accordance with the present invention, a succession of adjacent web sections 20 is generated.

As embodied herein, the perforator 120 generally includes a rotatable knife member 122 having a blade edge 124 corresponding to the series of perforations 35. For example, to create a continuous series of perforations 35 which are substantially elongate in shape, the blade edge 124 of the rotatable knife member 122 includes a series of elongate blade segments of similar dimension. Alternatively, if a continuous series of circular perforations 35 is preferred, the blade edge 124 of the rotatable knife member 122 is defined by a series of circular awl-type members. The blade edge 124 of the rotatable knife member 122 likewise corresponds to the desired overall shape of the perforated seam 30. That is, the blade edge 124 may be configured to provide either a linear perforated seam 30 transversely across the web 10, or a predefined shaped perforated seam 30 to create a particular profile for the top edge 25 of the produced handled bag 50.

Generally, the rotatable knife member 122 is an elongate member having a longitudinal axis of rotation and positioned to extend across the width W of the web 10. A perforated seam 30 is created transversely across the web 10 by each full rotation, i.e., 360°, of the rotatable knife member 122 about its axis of rotation. Hence, the predetermined interval between subsequently created perforated seams 30 is established by the dimension and rotational speed of the rotatable knife member 122, as well as the longitudinal speed at which the web 10 is fed through the perforator 120. In a preferred embodiment of the present invention, and as seen in FIG. 3, the rotatable knife member 122 includes a rotatable drum 123 with the blade edge 124 mounted thereon. Hence, additional blade edges 124 may also be mounted in a spaced relationship around the rotatable drum 123 to create a number of perforated seams 30 for each full rotation of the rotatable knife member 122, if desired.

The perforator 120 further includes a cooperating rotatable backing member 126 for engagement with the blade edge 124 of the rotatable knife member 122. As embodied herein, and as seen in FIG. 3, the cooperating rotatable backing member 126 is a corresponding rotatable drum 127 synchronously rotatable with the rotatable knife member 122. The rotatable backing member 126 may have either a rigid or a resilient backing surface 128 for engagement with the blade edge 124. The use of a resilient surface 128 on the rotatable backing member 126 ensures that the web 10 is urged into cutting engagement with the blade edge 124 to create the perforated seam 30, while the use of a rigid surface 128 creates a pinch-type perforation arrangement. Hence, the perforated seam 30 is created when the web 10 is fed between the edge 124 and the surface 128 as the knife member 122 and the backing member 126 are synchronously rotated. The resilient surface 128 is preferably formed by coating the backing member 126 with polyurethane or a similar material, while the rigid surface 128 may be provided by exposing the steel surface of the rotatable drum 127. Alternatively, it is possible to provide the rotatable backing member 126 with a slot for receiving the blade edge 124 to create the perforated seam 30.

Located downstream from the perforator, and in accordance with the present invention, the apparatus includes means for attaching at least one handle 40 to each web section 20 proximate one of the two subsequently created perforated seams 30. A variety of handle configurations may be used in conjunction with the apparatus of the present invention. Regardless of its configuration, and as seen in FIG. 2, each handle 40 generally includes a fixed end 42 to be attached to the web section 20 by the attaching means 130, and a free end 44 positioned to extend across the perforated seam 30 which is proximate to where the fixed end 42 of the handle 40 is attached. In the preferred embodiment of the present invention, two handles 40 are attached to each web section 20, each handle 40 including a flat base portion 43 and a substantially U-shaped portion 45 to define the handle's fixed end 42 and the free end 44, respectively. The flat base portion 43 is formed of kraft, while the U-shaped rope portion 45 is preferably twisted natural or bleached paper.

The handles 40 may be attached to the web 10 using adhesives, chemical or thermal bonding, staples, or other similar attachment means. In the preferred embodiment of the present invention, the means 130 for attaching the handles 40 includes an applicator 132 for applying an adhesive to the flat base portion 43 of each handle 40, and a positioner 134 for positioning each handle 40 on the corresponding web section 20 proximate a perforated seam 30. Each handle 40 may be positioned in a downstream directed orientation proximate the downstream one of the two subsequently created perforated seams 30 which define the corresponding web section 20, or as seen in FIG. 2, may be positioned in an upstream directed orientation proximate the upstream one of the two subsequently created perforated seams 30. The position and orientation of the handles 40 are dependent upon the manner in which the bottom end of each bag is closed, as will be discussed below.

A pressing device 136, such as a rotatable drum, may also be provided to ensure that the flat base portion 43 of each handle 40 is securely attached to the corresponding web section 20. Further in accordance with the present invention, the apparatus 100 may also include a device for forming each handle 40 to be attached. As is generally known, one such conventional handle forming device includes means for forming the substantially U-shaped portion, e.g., using a rope segment of predetermined length, and means for fixing the U-shaped portion to the flat base portion.

With at least one handle 40 attached proximate to each web section 20, the web 10 is then configured into a tubular configuration. As evident from FIGS. 2 and 3, the perforated seams 30 between the adjacent web sections 20 are maintained as the web 10 is configured into the tubular configuration. Hence, and in accordance with the present invention, the apparatus further includes a tube forming mechanism. Tube forming mechanisms are generally known, and need not be described in detail. It is sufficient to mention that a tube forming mechanism 140 typically includes a series of guide members and rotatable drums for folding the web 10 of sheet material into a flat tubular configuration and Joining opposite longitudinal edges 11 of the web 10 to complete the tubular configuration. The actual arrangement of the guide members and rotatable drums is dependent upon the tubular configuration desired. Further, although various joining methods are available, it is preferred that the opposite longitudinal edges 11 of the web 10 are joined by applying an adhesive to at least one of the longitudinal edges 11. Thus, the web 10 may be configured into a flat tubular configuration having a front panel, a back panel, and collapsible accordion side panel junctions therebetween to produce a self-opening square type handled bag 50.

In accordance with the present invention, the apparatus further includes a separating device for breaking the perforated seams 30 to separate the adjacent web sections 20. Each separated web section 20 has a top end 24 with the free end 44 of the attached handle 40 extending therefrom and a bottom end 26 opposite the top end 24. To break each of the perforated seams 30, and in accordance with the present invention, the separating device 200 includes a rotatable first breaker roll 210 having a pressure bar 216 provided thereon and a rotatable second breaker roll 220 having a cooperating gap 226 formed therein for receiving the pressure bar 216 as the first and second breaker rolls 210,220 are synchronously rotated. The pressure bar 216 applies a substantially discrete pressure along the perforated seam 30 to ensure that the perforated seam 30 is efficiently broken.

The first and second breaker rolls 210,220 are operatively coordinated with the perforator 120, such that the perforated seams 30 are successively aligned with the pressure bar 216 as the pressure bar 216 is received by the cooperating gap 226 with the web 10 fed therebetween. That is, and as embodied herein, the apparatus 100 is configured to ensure that each perforated seam 30 created by the blade edge 124 of the rotatable knife member 122 is aligned with the pressure bar 216 of the separating device 200 as the pressure bar 216 is received by the cooperating gap 226. To enable this alignment with the perforated seams 30, the first and second breaker rolls 210,220 are of the same effective diameter as the rotatable knife blade 122 and operated at the same constant speed. Alternatively, the first and second breaker rolls 210,220 each may be provided with a diameter different from that of the rotatable knife blade 122. Alignment with the perforated seams 30 would be maintained by varying the speed of rotation of the first and second breaker rolls 210,220, accordingly, such as by elliptical gears.

As embodied herein, the pressure bar 216 is generally an elongate element corresponding with the configuration or shape of the perforated seam 30, and positioned on the first breaker roll 210 so as to extend transversely across the web 10. That is, if the perforated seam 30 is substantially linear, the pressure bar 216 is a straight member which extends substantially across the web 10. However, if a shaped perforated seam 30 is created by the perforator 120 to produce a handled bag 50 with a profiled top edge 25, then the pressure bar 216 is shaped accordingly.

Figure 6A:
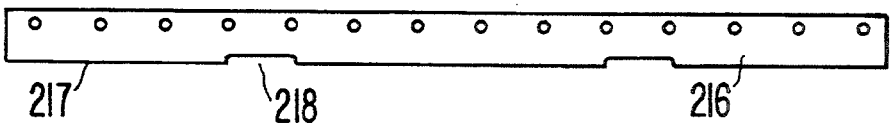
FIG. 6A is a front view of a pressure bar for the separating device of the present invention having a straight edge surface with formed relief notches.
Figure 6B:
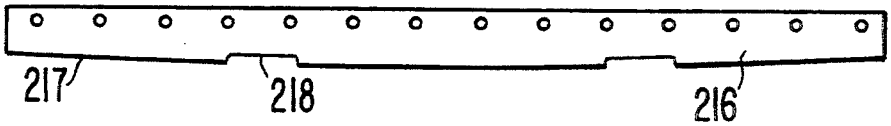
FIG. 6B is a front view of a pressure bar for the separating device of the present invention having a convex edge surface with formed relief notches.
Figure 6C:
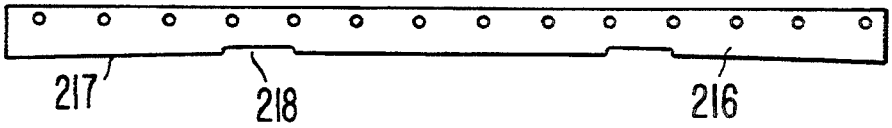
FIG. 6C is a front view of a pressure bar for the separating device of the present invention having a concave edge surface with formed relief notches.

Further embodied herein, the pressure bar 216 may be provided with a straight edge surface 217, as seen in the front view of FIG. 6A, or a contoured edge surface 217. Specifically, and with reference to the front view of FIG. 6B, a substantially convex edge surface 217 may be provided on the pressure bar 216. The convex edge surface 217 permits the perforated seam 30 to be broken initially in the center and then outwardly toward the opposite longitudinal edges of the folded tubular configuration. Further, if a self-opening square type bag is to be produced, the convex pressure bar 216 enables a substantially uniform pressure to be applied across the perforated seam 30 since the flat tubular configuration of the kraft bag is generally thicker along its outer edges due to the folded accordion side panel junctions. Alternatively, a substantially concave edge surface 217 may be provided on the pressure bar 216, as seen in the front view of FIG. 6C, to initially break the perforated seam 30 at its outer edges and then inwardly toward the center of the folded tubular configuration.

As further seen in FIGS. 4A, 5A, and 6A–6C, and as embodied herein, the edge surface 217 of the pressure bar 216 includes at least one relief notch 218 appropriately located therein to accommodate the handles 40. As noted above, two handles 40 are preferably attached to each web section 20, wherein each attached handle 40 of the, preferred embodiment includes a flat base portion 43 fixed to the web 10 and a substantially U-shaped twisted rope portion 45 which forms the free end 44 of the attached handle 40. When the web 10 is folded into a tubular configuration, as shown in FIG. 2, the attached handles 40 are aligned with each other to cross the perforated seam 30 at two locations. Accordingly, the preferred embodiment of the invention includes two relief notches 218 formed along the edge surface 217 of the pressure bar 216 to accommodate the attached handles 40 and permit each perforated seam 30 to be broken by the pressure bar 216 and cooperating gap 226 without disturbing the handles 40 attached proximate thereto.

The relief notches 218 along the edge surface 217 of the pressure bar 216 are incorporated to prevent inadvertent movement of the attached handles 40, thereby permitting operation of the apparatus 100 at production speeds. In the preferred embodiments of the present invention, each relief notch 218 has a length of between about $\frac{3}{4}$ and $1\frac{1}{2}$ inches, and a depth of about $\frac{1}{4}$ inch. However, the exact dimensions and locations of the relief notches 218 will depend upon the configuration of the handles 40 which are attached to the web 10.

As previously mentioned, and in accordance with the present invention, the separating device 200 also includes a rotatable second breaker roll 220 having a cooperating gap 226 formed therein. The cooperating gap 226 is provided with an opening 227 which is generally sized to receive the pressure bar 216 as the first and second breaker rolls 210,220 are synchronously rotated. Further, and as seen in FIGS. 4B and 5B, the cooperating gap 226 is provided with angled sidewalls 228 to permit rotational movement of the first and second breaker rolls 210,220 while the pressure bar 216 is received within the cooperating gap 226. Preferably, a resilient material 229 is provided within the cooperating gap 226 of the second breaker roll 220 to resiliently engage the pressure bar 216. The resilient material 229 ensures a more uniform application of the discrete pressure along the perforated seam 30 to separate adjacent web sections 20 without disturbing the attached handles 40 as the pressure bar 216 is received by the cooperating gap 226 with the web 10 fed therebetween. The resilient material 229 provided within the cooperating gap 226 is preferably polyurethane, although other similar materials may be used.

As seen in FIGS. 4B and 5B, the first and second breaker rolls 210,220 embodied herein are substantially cylindrical members 212,222, respectively. The pressure bar 216 may be provided directly on and the cooperating gap 226 may be formed directly in the cylindrical members 212,222 of the first and second breaker rolls 210,220, respectively. In the preferred embodiment, however, each of the first and second breaker rolls 210,220 includes a seat portion 213,223 for removably holding corresponding first and second breaker attachments 214,224. Specifically, the removable first breaker attachment 214 for the first breaker roll 210 includes a first mounting member 215 having the pressure bar 216 provided thereon, and the removable second breaker attachment 224 for the second breaker roll 220 includes a second mounting member 225 having the cooperating gap 226 formed therein. The removable breaker attachments 214,224 are securely held in the respective seat portions 213,223 of the first and second breaker rolls 210,220 with screws or similar securing means. In this manner, the first and second breaker rolls 210,220 may be readily adapted to correspond to any one of a variety of perforated seam configurations or shapes. The use of removable breaker attachments 214,224 also permits quick and easy maintenance and replacement of parts.

To further enhance the overall performance of the apparatus 100, the separating device 200 may include a pair of rotatable separator rolls 230 located downstream on the first and second breaker rolls 210,220. The pair of separator rolls 230 are synchronously rotated faster than the first and second breaker rolls 210,220 to substantially pull the separated web section 20 from the web 10 as the perforated seam 30 is broken by the pressure bar 216 and cooperating gap 226. This arrangement, as presented in FIG. 3, not only enhances the efficiency of the separating device 200 in breaking the perforated seam 30, but also forces the separated web section 20 into a spaced relationship from adjacent web sections 20 to prevent entanglement of the web sections 20 and malfunctioning of the apparatus 100.

Generally, the pair the separator rolls 230 include two rotatable drum members in constant engagement with each other, wherein the separator rolls 230 are synchronously rotated with the web 10 fed therebetween. Alternatively, one of the separator rolls 230 may be a driven segmented roll having an engagement portion which projects radially beyond the remaining circumferential portion of the segmented roll, while the other separator roll 230 is a freely rotatable drum. In this manner, each separated web section 20 is thus pulled from the web 10 as the engagement portion of the segmented roll correspondingly engages the freely rotatable drum.

Each of the separator rolls 230 is preferably provided with a friction surface to enhance the gripping action of the separator rolls 230 while pulling each separated web section 20 from the web 10. The friction surface is provided by coating each of the separator rolls 230 with polyurethane, or the like. If a segmented roll is utilized, only the engagement portion need be provided with the friction surface.

To complete the production of each handled bag 50 in accordance with the present invention, the apparatus also includes a bottom forming mechanism for closing the bottom end 26 of each separated web section 20. Such bottom forming mechanisms are known in the art, and generally include a series of guide members and rotatable drums, as well as sealing means, for folding and sealing the bottom end 26 of each web section 20 accordingly. The specific arrangement of the bottom forming mechanism 150 in the apparatus 100 of the present invention is dependent upon the bottom configuration desired for the produced handled bag 50. Once complete, the handled bag 50 is then fed to a conveyor assembly for inspection, packaging, and shipping.

EXAMPLE

The handled bag producing method and apparatus of the present invention is further clarified by the following example, which is provided purely for purpose of illustration and not limitation. The example established below and schematically presented in FIGS. 2 and 3 demonstrates a preferred embodiment of an apparatus 100 for producing kraft bags having twisted paper rope type handles 40. For production of the handled bags 50, a web 10 of substantially continuous sheet material which has been spooled on a roll 111 is selected. The web 10 of sheet material is bleached clay-coated kraft having a weight of about 65 #/ream and a width W of about 26 inches. The web roll 111 is supported on a roll stand 114 to be freely rotatable, with the web 10 being pulled from the web roll 111 by a pair of drive rollers 205 and fed into a perforator 120 at a speed of about 70 feet per minute.

The perforator 120 includes a rotatable knife member 122 having a blade edge 124, wherein the rotatable knife member 122 is a drum 123 having a diameter of about 5¼ inches and a length of about 37 inches. The blade edge 124 is provided with a series of ⅛ inch blade segments separated by 3/32 inches, which correspond to the series of perforations 35 to be created. The blade edge 124 is made of steel, and is configured to provide a linear perforated seam 30 across the web 10. The perforator 120 further includes a cooperating rotatable backing member 126 similar in size to the rotatable knife member 122, and having a rigid backing surface 128 made of steel thus providing a pinch-type perforation arrangement. The rotatable knife member 122 and cooperating rotatable backing member 126 are synchronously rotated at 50 revolutions per minute to create a perforated seam 30 transversely across the web 10 at a predetermined interval of about 16½ inches. Rotatable guide rollers 115 are provided to maintain tension in the web 10 and guide the direction of the web 10.

Handles 40 are then attached proximate one of the two subsequently created perforated seams 30 which define each web section 20. The handles 40 are produced separately, and attached proximate the corresponding perforated seam 30 through timed operation. Each handle 40 includes a flat base portion 43 having a substantially U-shaped twisted paper rope portion 45 affixed thereon. Prior to attachment of the handle 40, an adhesive such as starch/polyvinyl acetate is applied to the flat base portion 43. Each handle 40 is positioned in an upstream directed orientation proximate the upstream one of the two subsequently created perforated seams 30 with the twisted paper rope portion extending across the upstream perforated seam 30, as seen in FIG. 2. A rotatable pressing device 136 is provided to ensure that the flat base portion 43 of each handle 40 is securely attached to the corresponding web section 20.

A conventional tube forming mechanism 140 is utilized for configuring the web 10 into a tubular configuration having six longitudinal fold lines to form a self-opening square type handled bag 50 having a front panel, a back panel, and collapsible accordion side panel Junctions therebetween. The tube forming mechanism 140 includes an applicator (not shown) to join the opposite longitudinal edges 11 of the web 10 using an adhesive. At this point, the web 10 is being fed through the apparatus 100 flat tubular configuration at a constant longitudinal speed of 50 "blanks" or web sections per minute.

The separating device 200 presented herein includes a rotatable first breaker roll 210 having a diameter of about 4½ inches and a length of about 10½ inches. The first breaker roll 210 is made of steel and is provided with a seat portion 213 to hold a removable breaker attachment 214 having a pressure bar 216 mounted thereon. The pressure bar 216 is an elongate element made of steel, and is provided with a contoured edge surface 217 having two relief notches 218 formed therein. The elongate element has a length of about 10½ inches and a thickness of about 3/16 inch.

The separating device 200 further includes a rotatable second breaker roll 220 similar in dimensions and construction as the first breaker roll 210, wherein the second breaker roll 220 is provided with a removable breaker attachment 224 having a cooperating gap 226 formed therein. The cooperating gap 226 has opening 227 of about 5/16 inch and a depth of about ½ inch, and further includes angled sidewalls 228 to permit rotational movement of the first and second breaker rolls 210,220 while the pressure bar 216 is received within the cooperation gap. Resilient material 229, such as polyurethane, is provided within the cooperating gap 226. The first and second breaker rolls 210,220 are synchronously rotated at 50 revolutions per minute by elliptical gears appropriately configured to maintain the alignment of the pressure bar 216 with the perforated seams.

Immediately downstream of the first and second breaker rolls are a pair of separator rolls 230, each separator roll 230 has an effective diameter of about 6½ inches and a length of about 10 inches. One of the two separator rolls 230 is a segmented roll having an engagement portion coated with rubber to provide a friction surface for engagement with the other separator roll. The segmented roll is driven at greater than 50 revolutions per minute to engage with the other separator roll 230 and substantially pull each separated web section 20 from the web 10 as the perforated seam 30 is broken by the pressure bar 216 and cooperating gap 226 of the first and second breaker rolls 210,220, respectively.

A conventional bottom forming mechanism 150 is provided for closing the bottom end 26 of the separated web section 20, and thus completing production of the handled bag 50 in accordance with the present invention.

It will be apparent to those skilled in the art that various modifications and variations can be made to the bag producing method of the present invention, as well as the construction and configuration of the bag producing apparatus and separating device, without departing from the scope or spirit of the invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An apparatus for producing handled bags, the apparatus comprising:

a web dispenser for continuously feeding a web of sheet material through the apparatus;

a perforator for creating perforated seams transversely across the web at predetermined intervals to define a web section between two subsequently created perforated seams such that a succession of adjacent web sections is generated, wherein each perforated seam includes a continuous series of perforations sufficiently spaced apart to maintain a connection between adjacent web sections;

means for attaching at least one handle to each web section proximate one of the two subsequently created perforated seams, wherein the handle includes a fixed end attached to the web section and a free end extending across the proximate one of the two subsequently created perforated seams;

a tube forming mechanism for configuring the web into a tubular configuration;

a separating device for breaking the perforated seams to separate the adjacent web sections, each separated web section having a top end with the free end of the handle extending therefrom and a bottom end opposite the top end, wherein the separating device includes a rotatable first breaker roll having a pressure bar provided thereon and a rotatable second breaker roll having a cooperating gap formed therein for receiving the pressure bar as the first and second breaker rolls are synchronously rotated, such that the perforated seams are successively aligned with the pressure bar as the web is fed between the first and second breaker rolls and the pressure bar is received by the cooperating gap to break each perforated seam without disturbing the handle attached proximate thereto; and a bottom forming mechanism for closing the bottom end of each separated web section.

2. The apparatus of claim 1, wherein the perforator includes a rotatable knife member having a blade edge corresponding to the series of perforations and a cooperating rotatable backing member having a rigid backing surface for engagement with the blade edge to create each perforated seam when the web is fed between the knife member and the backing member as the knife member and the backing member are synchronously rotated.

3. The apparatus of claim 1, wherein the perforator includes a rotatable knife member having a blade edge corresponding to the series of perforations and a cooperating rotatable backing member having a resilient backing surface for engagement with the blade edge to create each perforated seam when the web is fed between the knife member and the backing member as the knife member and the backing member are synchronously rotated.

4. The apparatus of claim 1, wherein the separating device includes a resilient material provided within the cooperating gap of the second breaker roll to resiliently engage the pressure bar and break each perforated seam without disturbing the handle attached proximate thereto when the pressure bar is received by the cooperating gap with the web fed therebetween.

5. The apparatus of claim 1, wherein the separating device further includes a pair of rotatable separator rolls located downstream of the first and second breaker rolls, at least one of the separator rolls rotating faster than the first and second breaker rolls to substantially pull each separated web section from the web as the perforated seam is broken by the pressure bar and cooperating gap.

6. The apparatus of claim 1, wherein the pressure bar is an elongate element extending transversely across the web, the pressure bar having an edge surface with at least one relief notch appropriately located therein to accommodate the handle and permit each perforated seam to be broken by the pressure bar and cooperating gap without disturbing the handle attached proximate thereto.

7. The apparatus of claim 1, wherein the pressure bar is an elongate element extending transversely across the web, the pressure bar having a contoured edge surface.

8. The apparatus of claim 7, wherein the contoured edge surface of the pressure bar is substantially convex in shape.

9. The apparatus of claim 7, wherein the contoured edge surface of the pressure bar is substantially concave in shape.

10. The apparatus of claim 7, wherein the contoured edge surface of the pressure bar includes at least one relief notch appropriately located therein to accommodate the handle and permit each perforated seam to be broken by the pressure bar and cooperating gap without disturbing the handle attached proximate thereto.

11. A method for producing handled bags, the method comprising the steps of:

creating perforated seams transversely across a web of sheet material at predetermined intervals to define a web section between two subsequently created perforated seams such that a succession of adjacent web sections is generated, wherein each perforated seam includes a continuous series of perforations sufficiently spaced apart to maintain a connection between adjacent web sections;

attaching at least one handle to each web section proximate one of the two subsequently created perforated seams, wherein the handle includes a fixed end attached to the web section and a free end extending across the proximate one of the two subsequently created perforated seams;

configuring the web into a tubular configuration;

running the web through a separating device to break the perforated seams and separate the adjacent web sections, each separated web section having a top end with the free end of the attached handle extending therefrom and a bottom end opposite the top end, wherein the separating device includes a rotatable first breaker roll having a pressure bar provided thereon and a rotatable second breaker roll having a cooperating gap formed therein for receiving the pressure bar as the first and second breaker rolls are synchronously rotated, such that the perforated seams are aligned with the pressure bar as the web is fed between the first and second breaker rolls and the pressure bar is received by the cooperating gap to break each perforated seam without disturbing the handle attached proximate thereto; and closing the bottom end of each separated web section.

12. The method of claim 11, further including the step of providing the pressure bar of the first rotatable breaker roll with a contoured edge surface.

13. The method of claim 11, further including the step of pulling each separated web section from the web as the perforated seam is broken by the pressure bar and the cooperating gap.

* * * * *